United States Patent [19]

Weller

[11] Patent Number: 4,518,478

[45] Date of Patent: May 21, 1985

[54] LIQUEFACTION WITH MICROENCAPSULATED CATALYSTS

[75] Inventor: Sol W. Weller, Williamsville, N.Y.

[73] Assignee: The United States of America as represented by the United States Department of Energy, Washington, D.C.

[21] Appl. No.: 612,953

[22] Filed: May 23, 1984

[51] Int. Cl.[3] ..... C10G 1/00

[52] U.S. Cl. ..... 208/8 LE; 208/10; 502/159

[58] Field of Search ..... 208/10, 8 LE; 502/159

[56] References Cited

U.S. PATENT DOCUMENTS

| | | | |
|---|---|---|---|
| 3,429,827 | 2/1969 | Ruus | 264/4 |
| 3,790,497 | 2/1974 | Sato et al. | 264/4 |
| 3,909,444 | 9/1975 | Anderson et al. | 502/159 |
| 3,954,666 | 5/1976 | Marquisee et al. | 502/159 |
| 4,090,943 | 5/1978 | Moll et al. | 208/10 |
| 4,136,013 | 1/1979 | Moll et al. | 208/10 |
| 4,172,814 | 10/1979 | Moll et al. | 208/108 |
| 4,338,183 | 7/1982 | Gatsis | 208/10 |
| 4,369,106 | 1/1983 | Aldridge et al. | 208/10 |
| 4,424,110 | 1/1984 | Bearden, Jr. et al. | 208/10 |

OTHER PUBLICATIONS

Chien et al, "Coal Liquefaction with Encapsulated Catalyst", *I&EC Process Design & Development*, vol. 22, pp. 660–662, ACS, Oct. 1983.

*Primary Examiner*—Patrick P. Garvin
*Assistant Examiner*—Lance Johnson
*Attorney, Agent, or Firm*—Hugh W. Glenn; Robert J. Fisher; Judson R. Hightower

[57] ABSTRACT

A method of dispersing a liquefaction catalyst within coal or other carbonaceous solids involves providing a suspension in oil of microcapsules containing the catalyst. An aqueous solution of a catalytic metal salt is emulsified in the water-immiscible oil and the resulting minute droplets microencapsulated in polymeric shells by interfacial polycondensation. The catalyst is subsequently blended and dispersed throughout the powdered carbonaceous material to be liquefied. At liquefaction temperatures the polymeric microcapsules are destroyed and the catalyst converted to minute crystallites in intimate contact with the carbonaceous material.

14 Claims, No Drawings

LIQUEFACTION WITH MICROENCAPSULATED CATALYSTS

CONTRACTUAL ORIGIN OF THE INVENTION

The U.S. Government has rights in this invention pursuant to Grant No. DE-FG22-81PC40781 between the U.S. Department of Energy and The Research Foundation of State University of New York.

BACKGROUND OF THE INVENTION

Coal and other solid carbonaceous material can be effectively liquefied to form oil by contact with a suitable oil base solvent such as the recycled liquefaction product. Hydrogen is added as the coal dissolves to stabilize the product in liquid form. The use of a catalyst permits carrying out the process at lower temperatures and pressure than that of earlier liquefaction attempts.

It has long been appreciated that a good dispersion of the catalysts is an important factor in effective liquefaction. This invention relates to an improved method of catalyst distribution or dispersion within solid carbonaceous material. It also provides a more stable and convenient catalyst suspension.

The effective distribution of minute amounts of liquefaction catalyst throughout a powdered solid has been difficult and cumbersome. Where aqueous solution are used, large amounts of carbonaceous materials must subsequently be dried at large energy expense to remove the impregnating solution.

Therefore, in view of the above, it is an object of the present invention to provide an improved method of dispersing a liquefaction catalyst in a solid carbonaceous material.

It is a further object to provide a method of catalyst dispersion which results in good catalyst stability.

It is a further object to provide a suspension of liquefaction catalyst within water-immiscible oil that exhibits stable dispersion and good storage life.

In accordance with the present invention, a method of catalyst dispersion into a solid carbonaceous material for its liquefaction is provided. The method includes forming a solid suspension of microcapsules in carbonaceous liquid. The microcapsules have thermolabile, polymeric shells containing liquefaction catalysts. The solid carbonaceous material is contacted with the suspension at a decomposition temperature that is sufficient to destroy the microcapsule shells and provide intimate contact between the finely divided catalyst and the solid carbonaceous material.

In one other aspect of the invention, the suspension of microcapsules is formed by dissolving catalytic metal salt in an aqueous solution and blending the aqueous solution into a carbonaceous oil to form an emulsion of minute catalyst-containing droplets dispersed throughout the oil. The emulsion is converted to a solid suspension in oil by microencapsulating the minute droplets in individual capsules of polymeric thermolabile material.

In more specific aspects, the microcapsules are in a size range of about 1–20 micrometers and form a solution of about 20% solid suspension in oil with about $2\times10^9$ microcapsules per cubic centimeter of suspension.

In other more specific aspects of the invention, the solid suspension is formed at a first concentration of suspended solids for storage and subsequently diluted with additional carbonaceous oil to a second but lower concentration of suspended solids for contacting and liquefaction of the carbonaceous material.

In yet other aspects of the invention, the liquefaction catalyst is a water-soluble, metal salt selected from ammonium heptamolybdate, ferrous sulfate, nickelous chloride and stannous chloride. An important catalyst is ammonium heptamolybdate.

In still other aspects of the invention, the carbonaceous liquid is a generally water immiscible oil produced at least in part by the dissolution of solid carbonaceous material of the type into which the liquefaction catalyst is distributed. Where coal is employed as the solid carbonaceous material to be recycled, coal-derived liquid provides a suitable water immiscible oil for suspension of the microcapsules containing the catalyst.

In still other aspects of the invention, the suspension of microcapsules is heated to a sufficient decomposition temperature to destroy the microcapsule shells and provide a suspension of catalytic metal crystallites throughout the oil in intimate contact with the solid carbonaceous material.

In one other manner, finely divided liquefaction catalyst can be distributed into solid carbonaceous material by dissolving a catalytic metal compound in an aqueous solution and blending the aqueous solution into a carbonaceous oil to form an emulsion. The emulsion is converted to a solid suspension in carbonaceous oil by encapsulating the minute aqueous droplets to form a fine dispersion of microcapsules. The solid suspension is heated to a sufficient decomposition temperature to destroy the microcapsules and convert the emulsion droplets to fine crystallites of catalytic material suspended in oil. On contacting the solid carbonaceous material with the suspension of catalytic crystallites, the catalyst infuses throughout the carbonaceous solids. Where ammonium heptamolybdate is selected for dissolution in aqueous solution to form the minute droplets of emulsion and oil, the solid suspension of crystallites will include molybdenum trioxide. Temperatures of about 400°–500° C. decompose the microcapsules and initiate liquefaction of the solid carbonaceous material.

The invention also contemplates a suspension of finely divided liquefaction catalyst in oil for the liquefaction of solid carbonaceous material. The suspension includes a water-immiscible oil, a multiplicity of microcapsules suspended throughout the oil, which microcapsules include a thin shell of thermolabile polymer containing fine droplets of catalyst in aqueous solution. In one such suspension, microcapsules are about 1–20 micron size forming about a 20% by weight solid suspension in the oil and contain fine droplets of dissolved ammonium heptamolybdate in aqueous solution.

DETAILED DESCRIPTION OF THE PREFERRED EMBODIMENT

The method of the present invention has particular application to water-soluble catalysts. In general, such catalysts are not easily dispersed in an oil phase, but the large expenditures of energy for drying a large mass of coal or other particulate material wet with aqueous solution can be avoided through use of the present method.

The water-soluble catalyst selected for liquefaction use is dissolved to form an aqueous solution. A solution of generally high concentration is selected to minimize the amount of water evaporation required. For instance, the solubility of ammonium heptamolybdate in water is about 30 grams per 100 grams of solution. It is therefore convenient to use a concentrated, but unsaturated, aqueous solution containing between 15 and 30 grams of ammonium heptamolybdate per 100 grams of solution in forming the emulsion. The concentrated aqueous solution is vigorously agitated with a water immiscible oil to form an emulsion of minute droplets of aqueous solution. A colloid mill or other liquid shearing device such as a small orifice or nozzle can be employed where needed to provide the emulsion.

In a practicable process for the liquefaction of a carbonaceous material such as coal, the recycle product liquid can be employed in forming the emulsions containing the catalysts. However, it will be clear that other oils such as tetralin, decalin and related carbonaceous liquids also may be used.

The minute droplets of emulsified catalysts are enclosed in microcapsules by a interfacial polycondensation method. One illustration of this type method is shown in U.S. Pat. No. 3,429,827 to Ruus. For this purpose, this patent is incorporated by reference herein. In the present application, a thin polymer wall or shell is formed around the minute droplets of the aqueous catalytic solution, for instance, by the reaction of a diisocyanate with a polyfunctional amine. Although various reactants can be selected, some particular combinations include a diisocyanate, such as toluene diisocyanate reacted with a polyfunctional amine such as diethylene triamine to form a polyurea shell; diacid chloride reacted with ethylene diamine to form a polyamide shell and disulfonyl chloride reacted with hexamethylene diamine to form a polysulfonamide shell.

Ordinarily the polyfunctional amine is dissolved in the water phase which is vigorously blended or extruded through a small orifice into the oil phase to provide the emulsion. The diisocyanate can be dissolved previously in the oil phase to immediately provide encapsulation of the emulsion droplets. Alternatively, the diisocyanate may be introduced later to ensure good dispersion of the catalyst prior to microencapsulation.

A typical catalyst formation can involve a 20% by weight solid suspension including particles of about 1–20 micron microcapsules with an average diameter of about 6 microns. About $2\times10^9$ microcapsules per cubic centimeter of solid suspension can be provided.

This microencapsulation process results in a highly dispersed suspension of microcapsules in the oil base. When ready for use, the catalyst suspension can be well mixed with the solid carbonaceous material such as coal for liquefaction. Such mixing permits infusion of the microcapsules onto the outer surfaces and into the inter porosity of the carbonaceous material. On raising the slurry mixture to a liquefaction temperature, for instance 400°–500° C., the microcapsule shells are destroyed by the elevated temperature and by the vaporization of contained moisture to provide a dispersion of small crystallites of catalyst material. In the case of ammonium heptamolybdate, oxides or sulfides of molybdenum are formed. Typically molybdenum trioxide crystallites are present. A liquefaction process is conducted in a well known manner at the 400°–500° C. temperature and 500–3000 psi (3500–21000 Kpa) hydrogen pressure.

Experimental runs using the catalyst of the present invention were compared with liquefaction runs employing no catalyst, runs employing powdered catalysts mixed with powdered coal and runs using powdered coal impregnated with an aqueous solution of ammonium heptamolybdate (AM). Tetralin was employed as the liquefying solvent and the carrier for the dispersed microencapsulated catalysts. The manner of conducting these tests are more fully described in I&EC PROCESS DESIGN & DEVELOPMENT 22, p. 660 (ACS 1983) "Coal Liquefaction With Encapsulated Catalyst". This paper is specifically incorporated by reference herein. The runs were conducted at 400° C. and at 450° C. and the results are shown in Tables I and II respectively.

TABLE I

| | Coal Liquefaction at 400° C.[a] | | | | |
|---|---|---|---|---|---|
| Run No. | 3 | 4 | 5 | 6A | 6B |
| Catalyst (AM): Form | None | Powder | Impreg. | Encapsulated | |
| Amt. of Mo, g | — | 0.40 | 0.40 | 0.31 | |
| $P_f$, psia | 951 | 933 | 832 | 868 | 861 |
| $H_2$ consumed, moles | 0.104 | 0.146 | 0.325 | 0.295 | 0.293 |
| Naphthalene prod., moles | 0.083 | 0.068 | 0.020 | 0.039 | 0.033 |
| H transferred, moles[b] | 0.270 | 0.282 | 0.365 | 0.373 | 0.359 |
| Coal conv., wt % (maf) | 69.0 | 70.4 | 77.8 | 72.6[c] | 73.4[c] |
| Asphaltene, wt % | 39.0 | 39.6 | 44.1 | 40.0 | 42.3 |
| Oil, wt % | 28.7 | 29.1 | 32.3 | 31.4 | 29.5 |
| $CH_4$, wt % | 0.6 | 0.6 | 0.5 | 0.6 | 0.6 |
| $C_2$–$C_4$, wt % | 0.7 | 1.1 | 0.9 | 0.6 | 1.0 |

[a]40 g coal + 200 g (1.513 moles) tetralin, 1000 psia $H_2$ (cold); 1 hour at 400° C.
[b]H transferred = 2(Naphth. prod.) + $H_2$ consumed.
[c]Coal conv. calculated on basis that polymer becomes completely soluble in toluene after reaction.

TABLE II

| | Coal Liquefaction at 450° C.[a] | | | | |
|---|---|---|---|---|---|
| Run No. | 7 | 8 | 9 | 10A | 10B |
| Catalyst (AM): Form | None | Powder | Impreg. | Encapsulated | |
| Amt. of Mo, g | — | 0.40 | 0.40 | 0.31 | |
| $P_f$, psia | 1010 | 983 | 934 | 935 | 931 |
| $H_2$ consumed, moles | 0.104 | 0.124 | 0.186 | 0.210 | 0.211 |
| Naphthalene prod., moles | 0.270 | 0.237 | 0.215 | 0.221 | 0.218 |
| Aklyl ($C_4$) benzene, moles | 0.030 | 0.033 | 0.038 | 0.030 | 0.032 |
| H transferred, moles[b] | 0.614 | 0.565 | 0.578 | 0.622 | 0.615 |
| Coal conv., wt % (maf) | 90.0 | 91.4 | 93.9 | 93.1[c] | 93.2[c] |
| Asphaltene, wt % | 34.2 | 35.3 | 36.2 | 36.5 | 36.9 |
| Oil, wt % | 50.7 | 51.8 | 53.9 | 52.2 | 53.0 |
| $CH_4$, wt % | 3.0 | 2.7 | 2.4 | 2.7 | 2.6 |
| $C_2$–$C_4$, wt % | 2.1 | 1.6 | 1.4 | 1.7 | 1.7 |

[a]49 g coal + 200 g (1.513 moles) tetralin, 1000 psia $H_2$ (cold); 1 hour at 450° C.
[b]H transferred = 2(Naphth. prod.) − Alkyl benzene + $H_2$ consumed.
[c]Coal conv. calculated on basis that polymer becomes completely soluble in tetralin after reaction.

From the above results, it is seen that the liquefaction catalyst ammonium heptamolybdate (AM) dispersed in coal in accordance with the present method is at least as effective as when impregnated into the coal from aqueous solution. However, the inconvenience and energy consumption involved in impregnating and drying large quantities of powdered coal can be avoided with the method of the present invention. The results also show the present method to be substantially more effective than that of providing powdered mixtures of catalyst and coal. In addition, some advantage is reflected in hydrogen consumption over the aqueous impregnation method.

The present invention provides an improved method of dispersing a liquefaction catalyst in coal or other carbonaceous solids. The catalyst is protected for stability in microcapsules until it is to be used. It can be stored as a suspension in a water-immiscible oil that can readily be blended or diluted with the carbonaceous oil intended for the liquefaction of the carbonaceous solids.

It will be clear that various other metal salts, in addition to ammonium heptamolybdate can be microencapsulated for use as catalyst. The catalytic metal salts, ferrous sulfate, nickelous chloride, stannous chloride and mixtures of these salts are specifically contemplated within the scope of this invention.

Although the present invention is described in terms of specific materials, process steps and procedures, it will be clear that various modifications within the skill of the art may be made within the scope of the following claims.

The embodiments of this invention in which an exclusive property or privilege is claimed are defined as follows:

1. In a catalytic solid carbonaceous material liquefaction process, a method of catalyst distribution into said solid carbonaceous material comprising:

forming a solid suspension in carbonaceous liquid of liquefaction-catalyst-containing microcapsules having thermolabile, polymeric shells and contacting said solid carbonaceous material with said suspension at a decomposition temperature sufficient to destroy the microcapsule shells and to intimately contact said liquefaction catalyst with said solid carbonaceous material.

2. The method of claim 1 wherein the suspension of microcapsules is formed by:

dissolving catalytic metal salt in aqueous solution;

blending the aqueous solution into a carbonaceous oil to form an emulsion of minute, water soluble catalyst-containing droplets dispersed throughout the carbonaceous oil; and converting the emulsion to a solid suspension in oil by microencapsulating the minute droplets in individual capsules of thermolabile, polymeric material.

3. The method of claim 2 wherein the microcapsules are in a size range of 1–20 microns.

4. The method of claim 3 wherein about a 20% solid suspension in oil is formed with about $2\times10^9$ microcapsules per cubic centimeter of oil suspension.

5. The method of claim 2 wherein the solid suspension in oil is formed at a first concentration of solids for storage and subsequently diluted with additional carbonaceous oil to a second but lower concentration of solids for contact and liquefaction of the solid carbonaceous material.

6. The method of claim 1 wherein the liquefaction catalysts is a water-soluble metal salt selected from ammonium heptamolybdate, ferrous sulfate, nickelous chloride, and stannous chloride.

7. The method of claim 6 wherein the liquefaction catalysts is ammonium heptamolybdate.

8. The method of claim 1 wherein the carbonaceous liquid is a generally water-immiscible oil produced at least in part by the dissolution of solid carbonaceous material of the type into which the liquefaction catalyst is distributed.

9. The method of claim 8 wherein the solid carbonaceous material is coal.

10. The method of claim 1 wherein the suspension of microcapsules is heated to a decomposition temperature sufficient to destroy the polymeric shells and to form a suspension of catalytic metal crystallites throughout the carbonaceous liquid and in intimate contact with the solid carbonaceous material.

11. A method of distributing finely divided liquefaction catalyst into solid carbonaceous material comprising:

dissolving a catalytic metal compound in aqueous solution;

blending the aqueous solution into carbonaceous oil to form an emulsion;

converting the emulsion to a solid suspension in carbonaceous oil by encapsulating the emulsion droplets to form a fine dispersion of microcapsules;

heating the solid suspension in oil to a decompostion temperature sufficient to destroy the microcapsules and to convert the emulsion droplets to fine crystallites of catalytic material suspended in the oil;

contacting the solid carbonaceous material with the suspension of catalytic crystallites to infuse the catalytic crystallites throughout the carbonaceous solids.

12. The method of claim 11 wherein the catalytic metal compound is ammonium heptamolybdate in aqueous solution, wherein the solution is emulsified as minute droplets in oil and wherein the ammonium heptamolybdate converts to fine crystallites of oxide suspended in oil at the decomposition temperature.

13. The method of claim 12 wherein the suspension of fine crystallites includes molybdenium trioxide.

14. The method of claim 11 wherein the solid suspension in oil is heated to a temperature of 400°–500° C. to destroy the microcapsules and to convert the emulsified droplets to fine crystallites of catalytic material.

* * * * *